US006261443B1

(12) United States Patent
Eriksson

(10) Patent No.: US 6,261,443 B1
(45) Date of Patent: Jul. 17, 2001

(54) SYSTEM FOR HANDLING DRAIN WATERS OF DIFFERENT DEGREES OF CONTAMINATION

(76) Inventor: Bertil Eriksson, Markvägen 1D, SE-890 23 Själevad (SE)

( * ) Notice: Subject to any disclaimer, the term of this patent is extended or adjusted under 35 U.S.C. 154(b) by 0 days.

(21) Appl. No.: 09/331,035

(22) PCT Filed: Dec. 18, 1997

(86) PCT No.: PCT/SE97/02148

§ 371 Date: Jun. 15, 1999

§ 102(e) Date: Jun. 15, 1999

(87) PCT Pub. No.: WO98/28497

PCT Pub. Date: Jul. 2, 1998

(30) Foreign Application Priority Data

Dec. 20, 1996 (SE) ..... 9604764

(51) Int. Cl.[7] ..... C02F 9/00

(52) U.S. Cl. ..... 210/138; 210/87; 210/136; 210/142; 210/172; 210/253; 210/921; 137/255

(58) Field of Search ..... 210/747, 87, 142, 210/172, 252, 254, 919, 138, 921, 920, 136, 253; 4/318, 663, 665; 405/36, 37, 51, 39; 137/255, 571, 624.11, 256, 236.1

(56) References Cited

U.S. PATENT DOCUMENTS

| | | | |
|---|---|---|---|
| 3,503,413 | | 3/1970 | Rose, Jr. . |
| 4,136,010 | | 1/1979 | Pilié, et al. . |
| 4,465,594 | * | 8/1984 | Laak . |
| 4,618,421 | * | 10/1986 | Kantor . |
| 4,744,385 | * | 5/1988 | Houghton . |
| 4,796,311 | * | 1/1989 | Shankman . |
| 5,575,304 | * | 11/1996 | Hassett . |

FOREIGN PATENT DOCUMENTS

| | | | |
|---|---|---|---|
| 2726527 A1 | | 12/1978 | (DE) . |
| 3500130 | * | 7/1986 | (DE) . |
| 2681354 | * | 3/1993 | (FR) . |
| 389881 | | 11/1976 | (SE) . |
| B 409480 | * | 8/1979 | (SE) . |
| 9716608 AT | | 5/1997 | (WO) . |

* cited by examiner

*Primary Examiner*—Joseph W. Drodge
*Assistant Examiner*—Terry K. Cecil
(74) *Attorney, Agent, or Firm*—Zarley, McKee, Thomte Voorhees & Sease

(57) ABSTRACT

A drain water system includes a plurality of containers (7–9) within a building 1 for receiving respective drain waters differing in degree of contamination. A plurality of building 1 having such containers share a main drain water conduit leads to at least two stations (13–15) for receiving the respective drain waterd of differing degrees of contamination. Adjusting apparatuses (including, for example, pumps 17) sequentially discharge the containers depending upon their degree of drain water contamination. During a certain time period, drain waters of the same degree of contamination will be discharged into the main drain conduit and will then flow to a specific station.

11 Claims, 2 Drawing Sheets

SYSTEM FOR HANDLING DRAIN WATERS OF DIFFERENT DEGREES OF CONTAMINATION

FIELD OF THE INVENTION AND PRIOR ART

The present invention relates to a system and a method for transporting drain water depending upon the degree of drain water contamination.

A system of the above mentioned type is previously known from e.g. SE, B, 409 480, SE 389 881, DE 2 726 527, DE 3 500 130 and FR 2 681 354. The applicant's own, still unpublished, Swedish patent application 9503851-9 may also be mentioned. Thus, drain water contaminated to different degrees is divided and collected in different containers in such devices. So-called black water originating from toilets may therefor be collected in one container, blue water from showers, washbasins, bathtubs and similar may be collected in another container and so-called green water from sinks may be collected in yet another container. The containers must thereafter somehow be discharged for taking care of the separated drain water, wherein it is not possible to utilize the ordinary main drain water conduit for a plurality of buildings without stopping the separation and the whole point is thereby lost. It is therefor necessary to discharge the containers in question in some other way by completely separate conduits from the respective container to e.g. a deposit arrangement or to discharge the containers directly into tanks of vehicles and drive the drain water to a suitable location. There are also other possibilities such as exchanging the containers with empty ones when they are full.

All the actions available by utilizing any of the previously known devices for separation of drain water contaminated to different degrees are complicated and therefor expensive and they do not always lead to an optimum result from the separation point of view.

SUMMARY OF THE INVENTION

The object of the present invention is to provide a system of the type defined in the introduction, which enables an elimination of the above mentioned disadvantages of previously known such devices, as well as a method enabling an improved transport of drain water from buildings to an end station to take care of the drain water.

This object is according to the invention achieved by providing a device and a method according to the attached independent device and method patent claim.

A utilization of the main drain water conduit for transportation of the separated drain water is enabled by these different characteristics while maintaining the separation in the stations, such as purifying plants, to which the drain water arrives for being taken care of.

Thus, it is by means of such a "sequential drain" possible to transport drain water with a certain contamination character at a time in the main drain water conduit from all buildings connected to the same to a certain main drain water station without any mixture of drain water of some other contamination character therewith. Some type of container in the respective building is a prerequisite for such a "sequential drain". It would have been completely unreasonable to demand that the persons utilizing the different drain water receiving units should use certain units only during certain time periods. Another advantage with a system according to the invention is that it will be easy to drain the main drain water conduit when there is a need for renovation work on the main drain water conduit thanks to the presence of the adjusting apparatus.

According to a preferred embodiment of the invention the first drain water system section has at least three said parts and at least three said containers and the second drain water system section has at least three main drain water stations, and the adjusting apparatus is arranged to obtain discharging of drain water from one of said parts via the container in question in the main drain water conduit and to transport drain water therein to one of said main drain water stations at a time while simultaneously preventing discharging of drain water from the other parts in the main drain water conduit and preventing transport of drain water through the main drain water conduit to any of the main drain water stations associated with said other parts of the first system section. The same good separation of the drain water is in this way achieved at said stations as in the different buildings connected to the main drain water conduit, which is of course a great advantage. It is however pointed out that it is within the scope of the invention that there are e.g. three containers in the different buildings and that two containers are discharged simultaneously and this drain water is transported in the main drain water conduit, while discharging of a third container is prevented, said both containers of course having a main drain water station in common, and it is in such a case possible that the number of main drain water stations are less than the number of containers in a building. For instance, the above discussed "blue" and "green" water should thereby e.g. be able to be transported separated from the transportation of the "black" water.

According to a preferred embodiment of the invention the adjusting apparatus comprises members for an adjustable opening and closing of the flow communication through said conduits between said containers and the main drain water conduit, and according to another preferred embodiment of the invention the adjusting apparatus comprises members for an adjustable opening and closing of the flow communication between the main drain water conduit and the respective main drain water station. Such members of the adjusting apparatus ensure a possibility of maintaining optimum separation of drain water with different contamination characters from said containers to the main drain water stations.

According to another preferred embodiment of the invention the adjusting apparatus comprises a pump arranged in each of said conduits between each container and the main drain water conduit, said pump being formed to pump the drain water of the containers in question to the main drain water conduit during the time periods when discharging of said container is intended to take place. By utilizing a pump for the transport of drain water to the main drain water conduit, it is by easy means ensured that the main drain water conduit is provided with drain water of a certain contamination character during certain predetermined time periods.

According to another preferred embodiment of the invention each said conduit between said containers and the main drain water conduit is provided with a non-return valve for preventing a drain water flow from the main drain water conduit up to the respective container through the respective conduit. It is advantageous to arrange such a non-return valve in each conduit, while there is otherwise a risk that drain water with different contamination characters are being mixed due to that "wrong" drain water rises in one of said conduits and besides any thinkable risk for flowing at any container from the back is in this way prevented.

According to another very preferred embodiment of the invention it comprises conduits for connecting the main drain water conduit with means for receiving surface water, such as a street inlet or a surface water conduit, and members are arranged for an adjustable opening and closing of these connection conduits. The inventive characteristics enabling transport of drain water during certain time periods and also preventing transport of drain water during other time periods are in this way utilized in a very advantageous way, since there is a possibility to turn off the main drain water conduit temporarily during e.g. a few hours relating to transport of drain water at e.g. cloudburst and when there is a risk for flowing in the surface water gutters of the surface water system, and instead open said connection conduits on desired positions and letting surface water also flow in the drain water conduit for reducing the water level in the surface water system. Means are therefor advantageously arranged to guide the surface water transported in the main drain water conduit past the main drain water stations to the location, such as a lake, a stream or similar, where the surface water normally is being delivered by means of the surface water conduits in such a situation.

According to a preferred embodiment, which is a further development of the last mentioned embodiment, said members associated with the connection conduits are arranged to open the respective connection conduit by excess surface water in said means for receiving surface water, and that said members of the adjusting apparatus are arranged to simultaneously with such an opening close the flow communication between at least said first container and the main drain water conduit. The above described objects with the arrangement of said connection conduits are realized by such a device. It is also indicated that it is possible to allow transport of drain water with a less degree of contamination together with surface water in the main drain water conduit, which however possibly rather is to be avoided due to both the mixing and that it would be advantageous to completely be able to utilize the main drain water conduit as an extra surface water conduit when there is a risk for flowing in the surface water system, but you could also be more or less forced to transport drain water in the main drain water conduit if a need for surface water transport therein takes place during any time there is an urgent need for transport of water contaminated to a lower degree in the main drain water conduit.

According to another preferred embodiment of the invention the adjusting apparatus is arranged to prevent discharging of drain water from all said containers in the main drain water conduit during certain time periods. The already above discussed draining of the main drain water conduit is thereby enabled.

According to another preferred embodiment of the invention the adjusting apparatus is formed to realize its adjustment with said time periods between predetermined times in the day. This is advantageous when drain water in general and drain water with different degrees of contamination typically is being mainly produced during certain times of the day. Thus, it is by means of such a design of the adjusting apparatus possible to discharge the respective container at the time when it is most preferable.

According to another preferred embodiment of the invention it comprises members for measuring the flow passing by in at least one of said conduits between the container in question and the main drain water conduit. By a combination of a dividing of drain water with different degrees of contamination in different conduits connected to the main drain water conduit and an arrangement of said measuring members, it will be possible to introduce differentiated drain water charges, i.e. to debit the user for producing a certain amount of drain water with a certain degree of contamination, wherein it is possible that it is free to discharge drain water of another degree of contamination in the main drain water conduit or that the charge for doing it is another per unit volume than for the first mentioned drain water.

The advantages with the method according to the invention are clearly apparent from the discussion above of the device according to the invention.

Further advantages with the invention as well as advantageous characteristics will be apparent from the following description and from the other independent patent claims.

BRIEF DESCRIPTION OF THE DRAWINGS

With reference to the appended drawings, below follows a description of a preferred embodiment of the invention cited as an example. In the drawings.

DETAILED DESCRIPTION OF A PREFERRED EMBODIMENT OF THE INVENTION

Figure 1:
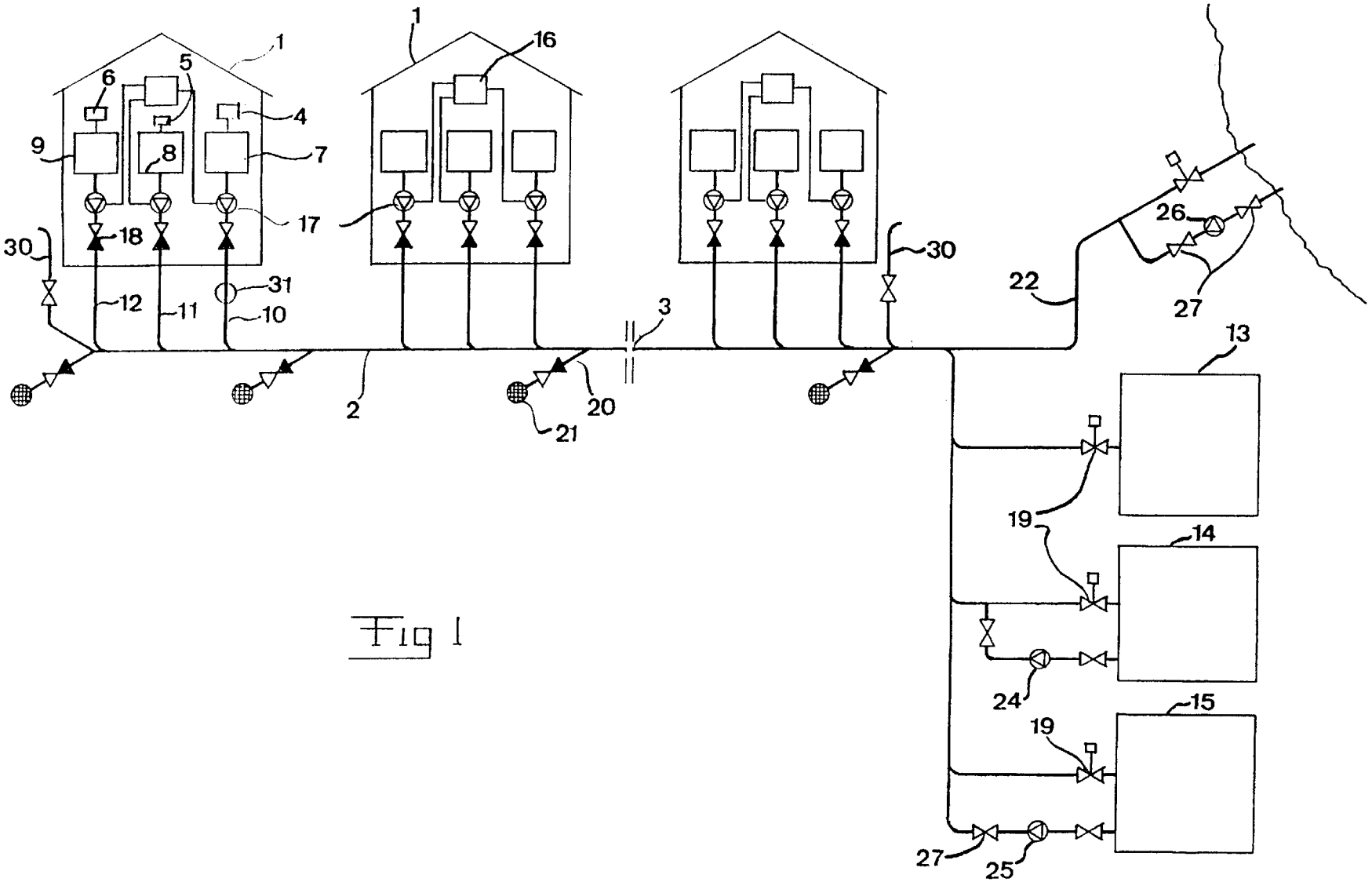
FIG. 1 is a schematical view illustrating a system according to a preferred embodiment of the invention.

It is in FIG. 1 illustrated how three different buildings 1 are connected to a main drain water conduit 2 in common, there are however in practise normally more buildings connected to such a main drain water conduit, which is also indicated at 3. Each building has a first system section of the complete drain water system, which is divided into three parts in this case, which are arranged to receive drain water contaminated to different degrees from drain water receiving units, said parts leading to a container each for collecting drain water received from the respective units. First, second and third such parts with units 4, 5 and 6 respectively are only shown in the left building in the very schematical FIG. 1, and thereto connected first, second and third containers are indicated by the squares 7, 8 and 9 respectively. The respective first container 7 is thereby arranged to collect so-called "black" water, i.e. water containing feces and urine originating from toilets. The containers 8 and 9 could be arranged for collecting "blue" and "green" water respectively according to the definitions above. It is of course also possible to have more containers, e.g. to separate urine and feces, or only two containers, while in this case one of them is intended for so-called black water, and the other for other drain water. Each container is connected to the main drain water conduit through a conduit 10, 11, 12, which leads to three different stations 13, 14, to take care of drain water of different qualities, and the intention is that the station 13 will take care of drain water originating from the first containers 7, the station 14 will take care of drain water from the second containers 8 and the station 15 will take care of drain water from the third containers 9.

The system comprises further an adjusting apparatus comprising schematically illustrated members 16 for controlling a pump 17 arranged in each conduit to discharge a container of a certain type, a first, a second or a third, during certain time periods, in the main drain water conduit for all buildings, while the pumps belonging to other types of containers are kept turned off. The conduits 10, 11 and 12 have further a non-return valve 18 each for preventing drain water flow from the main drain water conduit up to the respective container through the respective conduit.

The system has also members 19 in the form of valves for an adjustable opening and closing of the flow communication between the main drain water conduit and the respective main drain water station in order to admit intake of drain water of the type, which is being transported in the main drain water conduit at a certain moment to the main drain water station intended for this drain water type.

Figure 2:
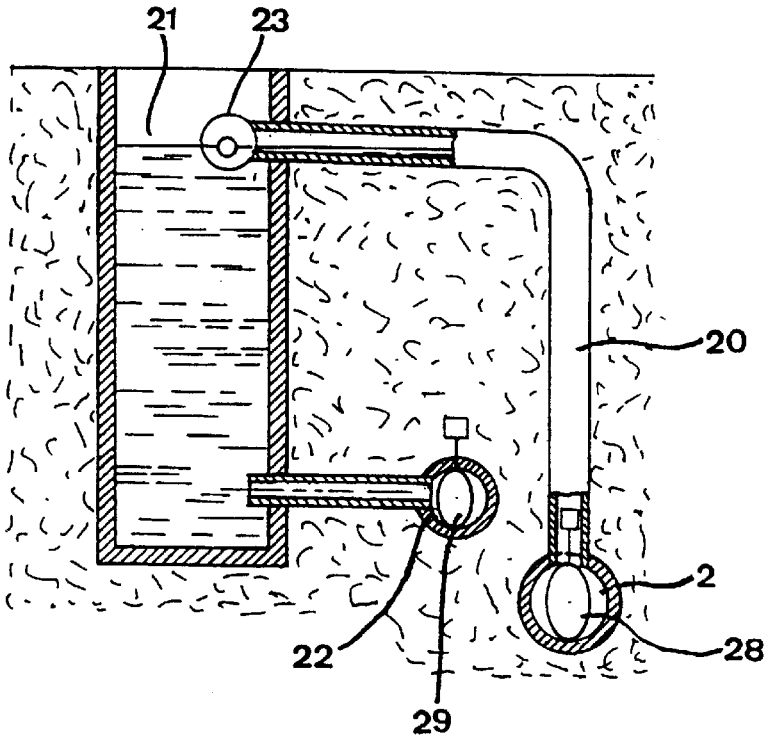
FIG. 2 is a partly cut view transversely in relation to the main drain water conduit of the system according to FIG. 1 in the vicinity of a surface water gutter, said view being enlarged in relation to FIG. 1.
Figure 3:
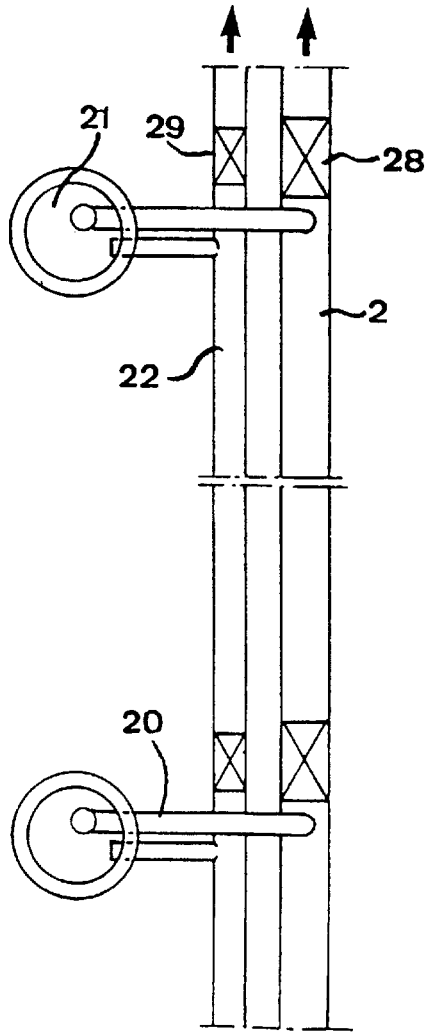
FIG. 3 is a simplified view from above of the main drain water conduit, the surface water conduit and a surface water gutter according to FIG. 2 of a part of the device according to FIG. 1.

It is now also referred to FIG. 2 and 3. The system comprises conduits for connecting the main drain water conduit 2 with means for receiving surface water, more exactly a surface water gutter 21 and indirectly with a surface water conduit 22, and members 23 are arranged for an adjustable opening and closing of these connection conduits. It is in FIG. 2 illustrated how a surface water gutter 21 has an overflow to the conduit 20 so that surface water may be led to the main drain water conduit 2 at rising of the water level in the gutter 21 up to the overflow if the adjusting member 23 opens the communication to the main drain water conduit 2.

The system has also pumps 24, 25 and 26 in return conduits from the second main drain water station 14, the third main drain water station 15 and the water course, from which the surface water is intended to be discharged, respectively for pumping water from these stations and from the water course into the main drain water conduit and the surface water conduit respectively for fire-fighting purposes. These return conduits have therefor valve members 27 for an optional closing and opening thereof. The possibility to fight fires will now briefly be described, although it is not the object of the present invention, due to that the present invention by means of the sequential drain water transport enables use of the drain water system in order to fight fires. Thus, the main drain water conduit 2 and the surface water conduit 22 have arranged valve members 28 and 29 respectively downstream of the respective surface water gutter 21, said valve members may be closed when there is a desire for filling the respective surface water gutter with water for fire-fighting purposes. There are further specific "outtakes" 30 from the main drain water conduit, alternatively the surface water conduit, for fire-fighting purposes by repumping water via any of the pumps 24, 25 and 26. Use of the main drain water conduit is enabled in order to fight fires due to that it may be determined during which time periods different types of drain water is being transported in the main drain water conduit, since it is possible to arrange that only water of a quality acceptable for fighting fires is present in the drain water conduit when there is a desire for such fire-fighting, i.e. at least the communication between said first container 7 and the main drain water conduit through the conduits 10 is closed.

The function of the system according to the invention appears from the discussion above. It may be added that only about 5% of the volume drain water delivered to a main drain water conduit is in this way so-called black water, so that it in principle would be enough transporting such black water during a time period of one hour a day in the main drain water conduit. Two time periods a day may however be chosen in practise for discharging the first containers 7, e.g. a short period in the morning and a short period late at night. The remaining time is disposable for transport of water contaminated to a less degree in the main drain water conduit or surface water therein. Thus, the time periods during which drain water is pumped from the containers 8 and 9 will be substantially longer—at least concerning the overall pumping time a day. A member 31 for measuring the drain water volume passing through the respective conduit 10 is indicated in the left building for enabling debit of the released volume of the specific drain water quality.

The invention is of course not in any way limited to the above described, preferred embodiment, but a plurality of possibilities of modifications thereof should be apparent for a man skilled in the art without departing from the invention idea, such as it is described in the attached claims.

A plurality of possible modifications have already been touched upon earlier and it may here e.g. be added that it is of course within the scope of the invention to provide a plurality of main drain water conduits, to which different buildings are connected, and which may emerge in a common main drain water conduit, or a plurality of main drain water conduits could lead to one or each of the main drain water stations. It would also be possible to combine the device according to the invention with conventional drain water systems, so that there are drain water systems without any separation parallel to the device according to the invention, wherein it would be possible to lead such drain water to the main drain water station arranged to take care of the drain water contaminated to a high degree.

What is claimed is:

1. A drain water system having a section located in a building with a first container arranged to receive first drain water contaminated to a relatively high degree, and a second container arranged to receive second drain water normally contaminated to a lower degree, characterized in that the drain water system has a main drain water conduit for a plurality of buildings each provided with one said section, the first and second containers are each connected to the main drain water conduit via respective conduits (10–12), said main drain water conduit leading to a plurality of stations comprising a first and a second station to receive the first and second drain waters, respectively, an adjusting apparatus is arranged to discharge drain water from said first containers into the main drain water conduit and to transport drain water therein to said first station during first time periods while simultaneously preventing discharging of drain water from the second containers into the main drain water conduit and to discharge drain water from the second containers into the main drain water conduit and to transport drain water therein to the second station during second time periods while simultaneously preventing discharging of drain water from the first container into the main drain water conduit.

2. A system according to claim 1, characterized in that the adjustaing apparatuus is arranged to discharge drain water from one of the containers into the main drain water conduit (2) and to transport drain water therein to one of said stations at a time while simultaneously preventing discharging of drain water from the other containers into the main drain water conduit and preventing transport of drain water through the main drain water conduit to the other of the stations.

3. A system according to claim 1, characterized in that the adjusting apparatus comprises members (17) for an adjustable opening and closing of the flow communication through said conduits (10–12) between said containers (7–9) and the main drain water conduit (2).

4. A system according to claim 1, characterized in that the adjusting apparatus comprises members (19) for an adjustable opening and closing of the flow communication between the main drain water conduit (2) and the respective stations (13–15).

5. A system according to any of the claim 2, characterized in that the adjusting apparatus comprises a pump (17) arranged in each of said conduits (10–12) between each container (7–9) and the main drain water conduit, said pump being formed to pump the drain water of the containers to the main drain water conduit (2) during the time periods when discharging of each said container is intended to take place.

6. A system according to claim 1, characterized in that each said conduit (10–12) between said containers (7–9) and the main drain water conduit (2) is provided with a non-return valve (18) for preventing a drain water flow from the main drain water conduit up to the respective container through the respective conduit.

7. A system according to any of the claim 2 characterized in that it comprises conduits (20) for connecting the main drain water conduit (2) with means (21, 22) for receiving surface water, and that members (23) are arranged for an adjustable opening and closing of these connection conduits.

8. A system according to claim 7, characterized in that said members (23) associated with the connection conduits (20) are arranged to open the respective connection conduit by excess surface water in said means for receiving surface water, and that said members of the adjusting apparatus are arranged to simultaneously with such an opening close the flow communication between at least said first container (7) and the main drain water conduit (2).

9. A system according to claim 8, characterized in that the adjusting apparatus is arranged to obtain closing of the flow communication between all said containers (7–9) and the main drain water conduit (2) by means of said members on opening of a flow communication between said means (21, 22) for receiving surface water and the main drain water conduit through the respective connection conduit (20).

10. A system according to claim 1, characterized in that the adjusting apparatus is arranged to prevent discharging of drain water from all said containers (7–9) to the main drain water conduit (2) during certain time periods.

11. A system according to claim 1, characterized in that it comprises members (31) for measuring the flow passing by in at least one (10) of said conduits (10–12) between the first container and the main drain water conduit.

* * * * *